US011140915B2

(12) United States Patent
Haddad

(10) Patent No.: US 11,140,915 B2
(45) Date of Patent: Oct. 12, 2021

(54) MULTIFUNCTIONAL DEVICES FOR SMOKING

(71) Applicant: Louay Haddad, Beirut (LB)

(72) Inventor: Louay Haddad, Beirut (LB)

(73) Assignee: HOLDPAT S.A.R.L, New York, NY (US)

( * ) Notice: Subject to any disclaimer, the term of this patent is extended or adjusted under 35 U.S.C. 154(b) by 228 days.

(21) Appl. No.: 16/147,656

(22) Filed: Sep. 29, 2018

(65) Prior Publication Data

US 2019/0183165 A1 Jun. 20, 2019

Related U.S. Application Data

(60) Provisional application No. 62/565,830, filed on Sep. 29, 2017.

(51) Int. Cl.
*A24F 15/00* (2020.01)
*B65D 5/24* (2006.01)
(Continued)

(52) U.S. Cl.
CPC ..... *A24C 5/42* (2013.01); *A24C 5/00* (2013.01); *A24C 5/44* (2013.01); *A24F 15/00* (2013.01);
(Continued)

(58) Field of Classification Search
CPC ..... A45F 15/00; A45F 17/00; A45F 15/18; B65D 5/2042; B65D 5/241; B65D 5/6685; B65D 5/02; B65D 5/10; A24C 5/42
(Continued)

(56) References Cited

U.S. PATENT DOCUMENTS 1,511,107 A 3/1920 Chambon
3,653,576 A 4/1972 Stranicky
(Continued)

FOREIGN PATENT DOCUMENTS

CH 687250 A5 10/1996
FR 2881110 A1 * 7/2006 ..... B65D 5/2066
(Continued)

OTHER PUBLICATIONS

International Search Report in PCT Appl. No. US2018/053680 dated Apr. 18, 2019.
Written Opinion in PCT Appl. No. US2018/053680 dated Apr. 18, 2019.

*Primary Examiner* — Anthony D Stashick
*Assistant Examiner* — L Kmet
(74) *Attorney, Agent, or Firm* — Tuggle Duggins P.A.; Blake P. Hurt

(57) ABSTRACT

A smoking device comprised of a rectangular middle panel comprising a central rectangular subpanel hingably joined to a lower rectangular subpanel, and hingably joined to an upper rectangular subpanel; a left panel hingably joined to a left edge of the rectangular middle panel and comprising a plurality of left panel facets hingably joined to each other; and a right panel hingably joined to a right edge of the rectangular middle panel and comprising a plurality of right panel facets hingably joined to each other. The lower rectangular subpanel and upper rectangular subpanel are pivotable with respect to the central subpanel to an opposed position forming an enclosed cavity. The left panel facets and right panel facets are pivotable so as to collapse and be contained within the enclosed cavity. Alternative embodiments with additional multifunctional capabilities are also described.

7 Claims, 13 Drawing Sheets

(51) Int. Cl.

| | |
|---|---|
| ***B65D 5/20*** | (2006.01) |
| ***A24C 5/42*** | (2006.01) |
| ***A24C 5/00*** | (2020.01) |
| ***A24C 5/44*** | (2006.01) |
| *A24F 15/18* | (2006.01) |
| *A24F 17/00* | (2006.01) |
| *A24C 5/12* | (2006.01) |

(52) U.S. Cl.
CPC ..... *B65D 5/2042* (2013.01); *B65D 5/241* (2013.01); *A24C 5/12* (2013.01); *A24F 15/18* (2013.01); *A24F 17/00* (2013.01)

(58) Field of Classification Search
USPC ..... 206/237
See application file for complete search history.

(56) References Cited

U.S. PATENT DOCUMENTS

| | | | |
|---|---|---|---|
| 4,281,788 | A | 8/1981 | Aeba |
| 8,584,854 | B2 | 11/2013 | Kesselman |
| 2004/0200852 | A1 | 10/2004 | Allison et al. |
| 2016/0128382 | A1 | 5/2016 | Staiano |

FOREIGN PATENT DOCUMENTS

| | | | |
|---|---|---|---|
| FR | 2881110 | A1 | 7/2006 |
| FR | 3040590 | A1 | 3/2017 |
| GB | 2534843 | A | 8/2016 |
| WO | 2007007197 | A2 | 1/2007 |
| WO | 2008084189 | A1 | 7/2008 |
| WO | 2010144063 | A1 | 12/2010 |
| WO | 2017050735 | A1 | 3/2017 |

* cited by examiner

MULTIFUNCTIONAL DEVICES FOR SMOKING

CROSS-REFERENCE TO RELATED PATENT APPLICATIONS

This application claims the benefit of U.S. Provisional Patent Application No. 62/565,830, filed Sep. 29, 2017, the disclosure of which is incorporated herein by reference. The above benefit claim is being made in an Application Data Sheet submitted herewith in accordance with 37 C.F.R. 1.76 (b)(5) and 37 C.F.R. 1.78.

TECHNICAL FIELD

The present disclosure relates to products for use by a person in making individual cigarettes and cigars. More particularly, products having multifunctional capabilities for making individual cigarettes and cigars.

BACKGROUND ART

The smoking of dried plant matter, such as dried tobacco leaves, has been practiced by humans for thousands of years, both for recreational and medicinal purposes. Such smoking is typically practiced using pipes, or by forming a cigar or cigarette by rolling finely ground plant matter within a suitable sleeve material. In forming a cigar, a large piece of tobacco leaf is used as the sleeve. In forming a "roll your own" cigarette (as practiced by a person), a thin piece of specialty paper, referred to as a rolling paper, is used. The forming of an individual cigarette by hand is a delicate operation, and many problems may be encountered in the operation. A considerable amount of manual dexterity is required to form a cigarette that has desired properties with respect to content, shape, structural firmness, and ease of air draw through the cigarette.

Generally, rolling papers are available for sale to the general public. Such rolling papers are provided in small packets or boxes of papers containing individual papers. Typically, these packages are provided as paper dispensers, and include a closure that has only one function, which is to protect the rolling papers.

Problems arise when the smoker wants to roll a cigarette. The smoker must gather his smoking articles (such as rolling papers and e.g., tobacco) and start the rolling preparation in a desirable location. The smoker must look for a clean smooth surface, where the conditions conduct to maintain health and prevent disease, since the rolled article ends in the mouth of the smoker.

Prior to the rolling process, the smoker must have or look for a container or bowl to mix his tobacco if needed, without having it scattered around. Some smokers prepare first the mix of tobacco evenly on any flat surface, and then improvise ways and solutions from anything around to lift the mix on a rolling paper. Once the rolling preparation has started, it is very difficult to pause it, and do another activity, or move to another location and then resume the rolling process without losing or exposing tobacco.

Also, once the rolling process has started, the smoker needs to hold the rolling paper with one hand and spread the tobacco evenly in the fold of the paper using the other hand without spilling tobacco from either end of the paper, while maintaining the paper in a stable position at all times. Additionally, during the rolling process, the smoker may spill and lose excess tobacco from his rolling paper, in the absence of the clean support for the residue to be collected.

Once the rolling process is finished and the cigarette is ready for smoking, the smoker cannot save his rolled cigarette or any other article easily without it being exposed to the elements for later usage.

Attempts have been made to provide smokers with simple portable tools that provide a tobacco mixing vessel and a rolling paper holding tray, along with a storage compartment for rolling papers. However, to the best of the Applicant's knowledge, there is no single smoker's device for making individual cigarettes that has the attributes required to address the above problems. There is therefore a need for a smoker's device that has multifunctional capabilities of rolling paper storage, finished cigarette storage, a tobacco mixing vessel, and a cigarette paper holding and rolling tray that is simple to use and does not require a high degree of instruction, manual dexterity, and practice to use effectively.

DISCLOSURE OF THE INVENTION

The present invention meets this need by providing devices that are useful as multifunctional tools for storing smoking items, performing the various steps in making an individual cigarette, and storing individual cigarettes for later use. The devices are adaptable to serve various needs for handling smokable plant substances, but are not limited only to such uses. The devices may be used to handle granular materials in many other applications.

In one aspect of the present disclosure, a simple device is provided which is foldable into multiple configurations that provide a V-shaped deck, a tray, and an internal compartment for storage.

In another aspect of the present disclosure, a device is provided having a re-foldable structure which, in a folded and locked position, forms a trapezoidal shaped package including an internal compartment for storage; and when unfolded, transforms into a wearable rolling device and multifunctional rolling aid tools for manual rolling of cigars and/or cigarettes.

The device includes a body comprising an upper narrow band and a lower narrow band which are connected, respectively, to a cover for closure, thereby protecting smoker's articles such as, but not limited to rolling papers, filter tips, lighters, matches, and any article related to rolling aid tools. The device is further configurable to form a capsular shaped section designed to perfectly fit a dispensed rolling paper wherefrom; a trapezoidal container when locked; and a V-Deck shaped when two bulges or side panels unfold laterally to the outside.

The device is further configurable to form a finger wearable rolling aid device when the cover is reversibly folded and both edges thereof are slipped into cut slots to lock, forming a hollow trapezoidal prism, fittable to/engageable with any user's finger, thereby enabling rolling on the go while preventing the tobacco or other content from spilling out. Additionally, a tray or bowl is projected when certain panels are inverted or popped backwards, thereby gathering all tobacco residues during the rolling process. An internal compartment is formed when the device is re-folded to a closed configuration and locked, thereby enabling pausing the cigarette rolling process at any phase, securing the paper, and air tightening the internal storage volume, holding the content for later usage.

More particularly, in accordance with the present disclosure, a granular material handling device (referred to herein as a smoking device, but not limited only to smoking use) is provided, which comprises a sheet of material formed in a specific geometric pattern. The sheet of material is thin and flexible so as to be foldable along certain line segments, thereby forming certain panels, subpanels, and facets. The device may be folded in different configurations so as to serve different functions for the smoker as described previously, as will be described in further detail.

In one embodiment, the smoking device is comprised of a rectangular middle panel comprising a central rectangular subpanel hingably joined to a lower rectangular subpanel, and hingably joined to an upper rectangular subpanel; a left panel hingably joined to a left edge of the rectangular middle panel and comprising a plurality of left panel facets hingably joined to each other; and a right panel hingably joined to a right edge of the rectangular middle panel and comprising a plurality of right panel facets hingably joined to each other. The lower rectangular subpanel, upper rectangular subpanel, central subpanel, left panel facets, and right panel facets are selectively pivotable with respect to each other so as to render the device in one of a closed configuration, a V-deck configuration, or a tray configuration.

The V-deck configuration is formable by pivoting the lower rectangular subpanel and upper rectangular subpanel with respect to the central subpanel to form a cavity having trapezoidal cross-sectional shape, and by pivoting the left panel facets with respect to each other so as to form a first end of the cavity, and by pivoting the right panel facets with respect to each other so as to form a second end of the cavity. The tray configuration is formable by inverting the position of the central subpanel with respect to the lower rectangular subpanel and upper rectangular subpanel, and by inverting pairs of left lateral facets with respect to a left central facet, and by inverting pairs of right lateral facets with respect to a right central facet.

The lower rectangular subpanel and upper rectangular subpanel are pivotable with respect to the central subpanel to an opposed position forming an enclosed cavity. The left panel facets are pivotable with respect to each other so as to collapse and be contained within the enclosed cavity, and the right panel facets are also pivotable with respect to each other so as to collapse and be contained within the enclosed cavity. The smoking device can thus be formed in a closed configuration.

The device may further comprise a tab panel hingably joined to an outer edge of the upper rectangular subpanel. In such an embodiment, when the lower rectangular subpanel and upper rectangular subpanel are pivoted with respect to the central subpanel to the opposed position to form the enclosed cavity, the tab panel is engageable in a slot formed between the lower rectangular subpanel, a first panel facet of the left panel, and a first panel facet of the right panel, thereby securing the smoking device in the closed configuration. The tab panel or closure panel may alternatively be attached to an outer edge of the lower rectangular subpanel, in which case the functions of the lower rectangular subpanel and upper rectangular subpanel are revered when placing the device in the closed configuration.

In certain embodiments, one of the left panel facets of the left panel may be a triangular facet hingably joined to a left edge of the central rectangular subpanel, and one of the right panel facets of the right panel may be a triangular facet hingably joined to a right edge of the central rectangular subpanel. In such an embodiment, when the lower rectangular subpanel and upper rectangular subpanel are pivoted with respect to the central subpanel to the opposed position to form the enclosed cavity, the triangular facet of the left panel forms a left end of the enclosed cavity, and the triangular facet of the right panel forms a right end of the enclosed cavity.

The smoking device may be configured in a tray configuration. To form it in such a configuration, the lower rectangular subpanel and upper rectangular subpanel are each pivoted upwardly with respect to the central subpanel to an obtuse angle to form a central portion of a tray cavity, and wherein each of the left panel facets are pivoted in a left sequence of obtuse angles with respect to an adjacent left panel facet to form a left portion of the tray cavity, and each of the right panel facets are pivoted in a right sequence of obtuse angles with respect to an adjacent right panel facet to form a right portion of the tray cavity. The tab panel may be pivoted downwardly at an obtuse angle relative to upper rectangular subpanel, so as to serve as a tray handle for the user.

The smoking device may be configured in a V-shaped deck ("V-deck") configuration. In such a configuration, the lower rectangular subpanel, a first portion of the left panel facets and a first portion of the right panel facets are pivoted upwardly with respect to the central subpanel, and with respect to a second portion of the left panel facets and a second portion of the right panel facets. In this configuration, a fold line between the lower rectangular subpanel and the central subpanel, a fold line between the first portion of the left panel facets and the second portion of the left panel facets, and a fold line between the first portion of the right panel facets and the second portion of the right panel facets may be substantially collinear. Additionally, the lower rectangular subpanel, the first portion of the left panel facets and the first portion of the right panel facets may be substantially coplanar in a first plane, and the central subpanel, the second portion of the left panel facets and the second portion of the right panel facets may be substantially coplanar in a second plane. The first plane may be at an angle of between about 45 and 135 degrees relative to the second plane.

In accordance with the present disclosure, an alternative smoking device is provided, similar to the above-described smoking device, but with additional multifunctional capabilities. The smoking device is formed from a sheet of material and is comprised of a rectangular middle panel comprising a central rectangular subpanel hingably joined to a lower rectangular subpanel, and hingably joined to an upper rectangular subpanel; a left panel hingably joined to a left edge of the rectangular middle panel and comprising a plurality of left panel facets hingably joined to each other; and a right panel hingably joined to a right edge of the rectangular middle panel and comprising a plurality of right panel facets hingably joined to each other, and an extension middle panel hingably joined to an outer edge of the upper rectangular subpanel and comprising a plurality of subpanels hingably joined to each other at fold lines parallel to the outer edge of the upper rectangular subpanel. The lower rectangular subpanel and upper rectangular subpanel are pivotable with respect to the central subpanel to an opposed position forming an enclosed cavity. The left panel facets are pivotable with respect to each other so as to collapse and be contained within the enclosed cavity, and the right panel facets are also pivotable with respect to each other so as to collapse and be contained within the enclosed cavity.

The plurality of subpanels of the extension middle panel may be folded to form a second enclosed cavity, which may be used to store rolling papers or other smoking items. The plurality of subpanels of the extension middle panel may be folded to form an open-ended cavity, placing the device in a wearable configuration. A user may insert a thumb or finger(s) into the open ended cavity, and proceed with cigarette making operations while wearing the device on his hand. The device may also be formed in a tray configuration, or a V-deck configuration as described above.

BRIEF DESCRIPTION OF THE DRAWINGS

The present disclosure will be provided with reference to the following drawings, in which like numerals refer to like elements, and in which.

Figure 1:
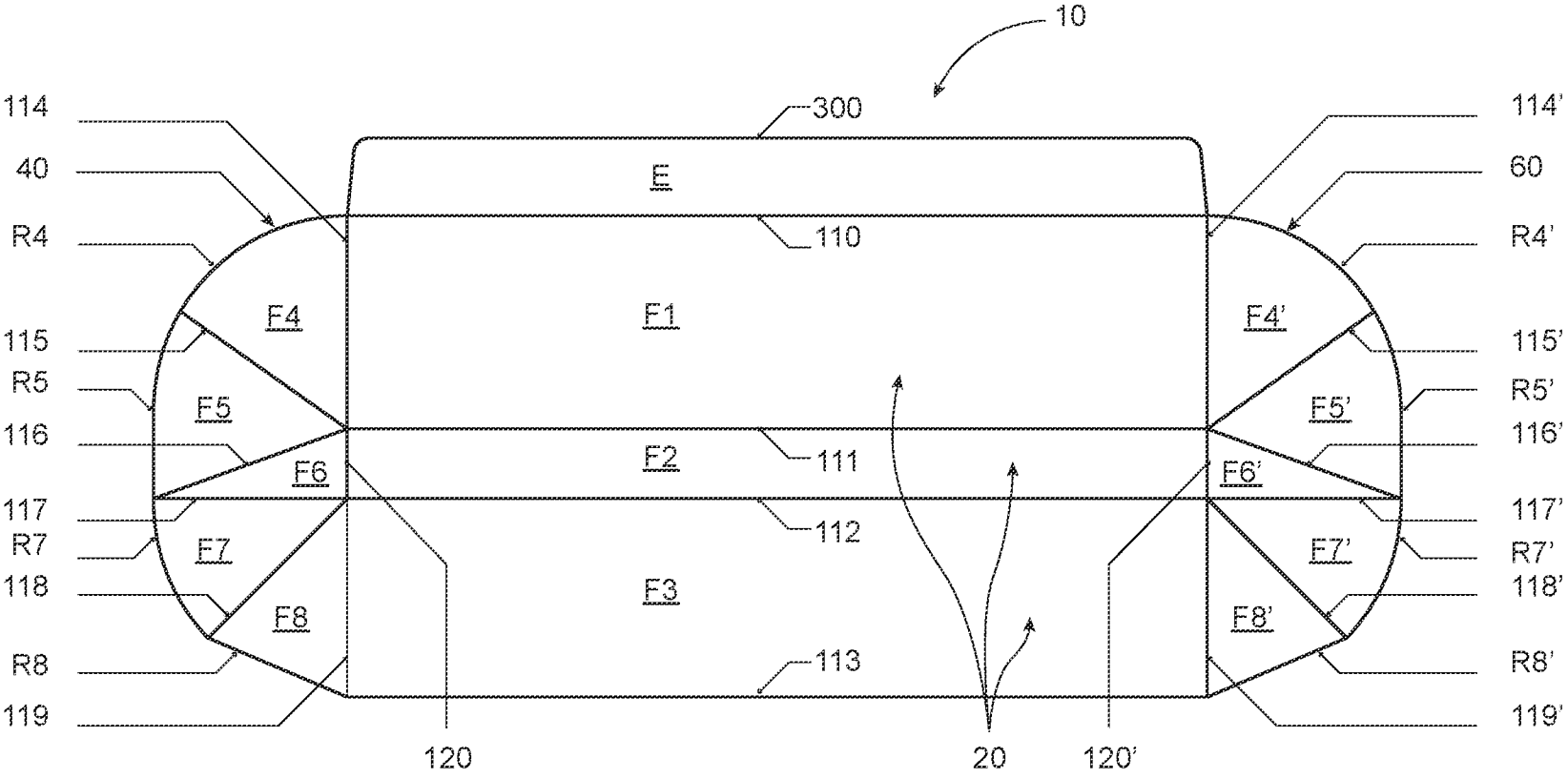
FIG. 1 is a plan view of a piece of sheet material cut in a pattern for forming a first embodiment of a smoking device of the present disclosure, shown with the top side ("A" side) facing upwardly (out of the page)

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

BEST MODE FOR CARRYING OUT THE INVENTION

For a general understanding of the present invention, reference is made to the drawings. In the drawings, like reference numerals have been used throughout to designate identical elements. The drawings are to be considered exemplary, and are for purposes of illustration only. The dimensions, positions, order and relative sizes reflected in the drawings attached hereto may vary.

In the following disclosure, the present invention is described in the context of its use as a device for making individual cigarettes for smoking. However, it is not to be construed as being limited only to use in cigarette fabrication and smoking. The invention is adaptable to any use in which there is a need to form a generally cylindrical device having a thin exterior sleeve of material containing a granular material therein, or to any use in which there is a need to have a portable and collapsible device for handling granular materials. Additionally, the instant disclosure may identify certain components with the adjectives "top," "upper," "bottom," "lower," "left," "right," "middle,' "central," etc. These adjectives are provided in the context of the orientation of the drawings, which is arbitrary. The description is not to be construed as limiting the device to use in a particular spatial orientation. The instant device may be used in orientations other than those shown and described herein.

The smoking device may be described at certain points herein in the context of its use in fabricating tobacco cigarettes. However, it is to be understood that the device is useful for the fabrication of cigarettes containing other plant matter, such as herbs and the like.

It is also to be understood that any connection references used herein (e.g., attached, coupled, connected, and joined) are to be construed broadly and may include intermediate members between a collection of elements and relative movement between elements unless otherwise indicated. As such, connection references do not necessarily imply that two elements are directly connected and in fixed relation to each other.

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the inventive scope of the present disclosure.

A first embodiment of a smoking device of the present disclosure will now be described with reference to FIGS. 1-8. Referring first to FIG. 1, fabrication of the smoking device 10 begins by cutting a piece of sheet material in a pattern that enables the formation of the device 10 by folding along certain line segments to form desired subpanels and facets. Suitable sheet materials include heavy paper card stock, thin cardboard, and thin plastic sheet materials, such as polypropylene or polyethylene.

The smoking device 10 is comprised of a rectangular middle panel 20, a left panel 40, and a right panel 60. The rectangular middle panel 20 is comprised of a central rectangular subpanel F2 hingably joined to a lower rectangular subpanel F3, and hingably joined to an upper rectangular subpanel F1. (As used herein, the term "hingably joined" is used in reference where two panels, subpanels, and/or facets are joined to each other in a manner such that they may be pivoted along a line segment that defines the joining location. Such a line segment or joining location is also referred to herein as a fold line. Fold lines define edges of adjacent panels, subpanels, and/or facets, as such pivoting of one panel, subpanel, and/or facet relative to another results in edges being formed at the fold. Depending upon the configuration of the smoking device 10, such pivoting of one panel, subpanel, or facet may occur up to nearly 360 degrees of total swept angle relative to the other.)

The left panel 40 is hingably joined to a left edge of the rectangular middle panel 20 at fold lines 114, 120, and 119, and comprises a plurality of left panel facets F4-F8 hingably joined to each other. In like manner, the right panel 60 is hingably joined to a right edge of the rectangular middle panel 20 at fold lines 114', 120', and 119', and comprises a plurality of right panel facets F4'-F8' hingably joined to each other.

Figure 4:
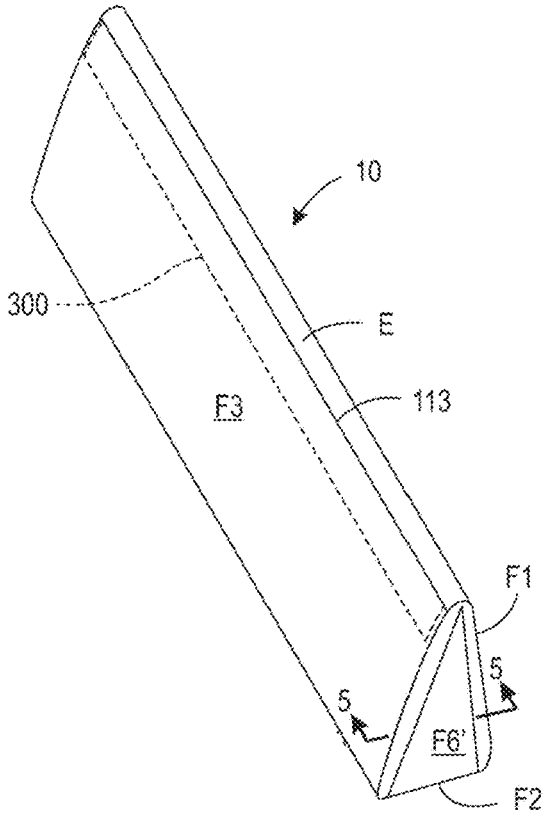
FIG. 4 is a perspective view of the smoking device of FIG. 1, folded to a closed configuration.
Figure 5:
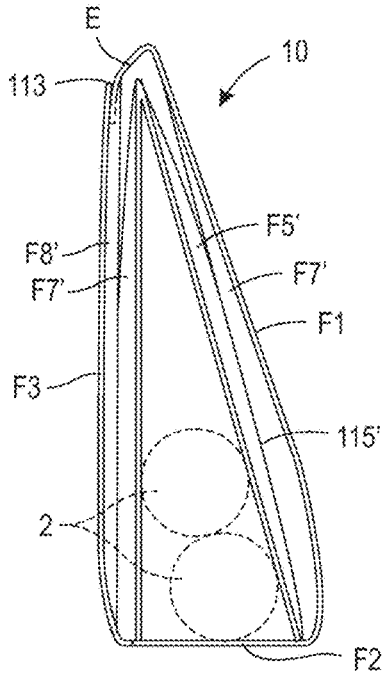
FIG. 5 is an end view of the smoking device in the closed configuration, taken along the line 5-5 of FIG. 4.

The lower rectangular subpanel F3 and upper rectangular subpanel F1 are pivotable with respect to the central subpanel F2 to an opposed position forming an enclosed cavity. The left panel facets F4-F8 are pivotable with respect to each other so as to collapse and be contained within the enclosed cavity, and the right panel facets F4'-F8' are also pivotable with respect to each other so as to collapse and be contained within the enclosed cavity. This is best understood with reference to FIGS. 2-5, which depict a sequence of foldings to convert the smoking device 10 in a planar unfolded state (FIG. 1) to a completely folded and closed state (FIGS. 4 and 5). In describing the folding of the smoking device 10 into these various configurations, the folding motions of the various panels, subpanels, and facets (upwardly, downwardly, etc.) are described relative to the original position of the smoking device 10 in an unfolded state on a horizontal surface as shown in FIG. 1. However, it is to be understood that in making the folds, a user will likely pick the smoking device 10 up off the surface in sheet form and proceed to fold it using the fingers of both hands, holding it in various positions. It is also to be understood that the order of making the folds may vary from the order presented below.

Figure 2:
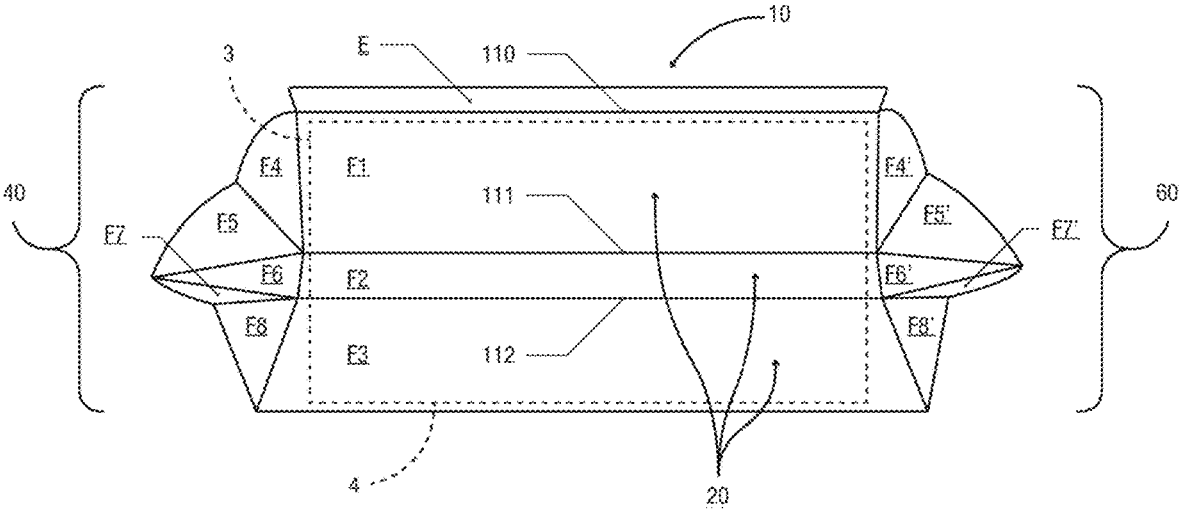
FIG. 2 is a plan view of the smoking device of FIG. 1 comprising the piece of sheet material initially folded to form a V-deck configuration useful for mixing tobacco and/or rolling a cigarette therein.

Referring first to FIG. 2, the smoking device of FIG. 1 is shown initially folded to form a V-deck useful for mixing tobacco and/or rolling a cigarette therein. Such a V-deck configuration is further depicted in as the intermediate configuration in FIG. 8. (The use of the device configurations in mixing tobacco and fabricating a cigarette will be described subsequently herein.)

Figure 8:
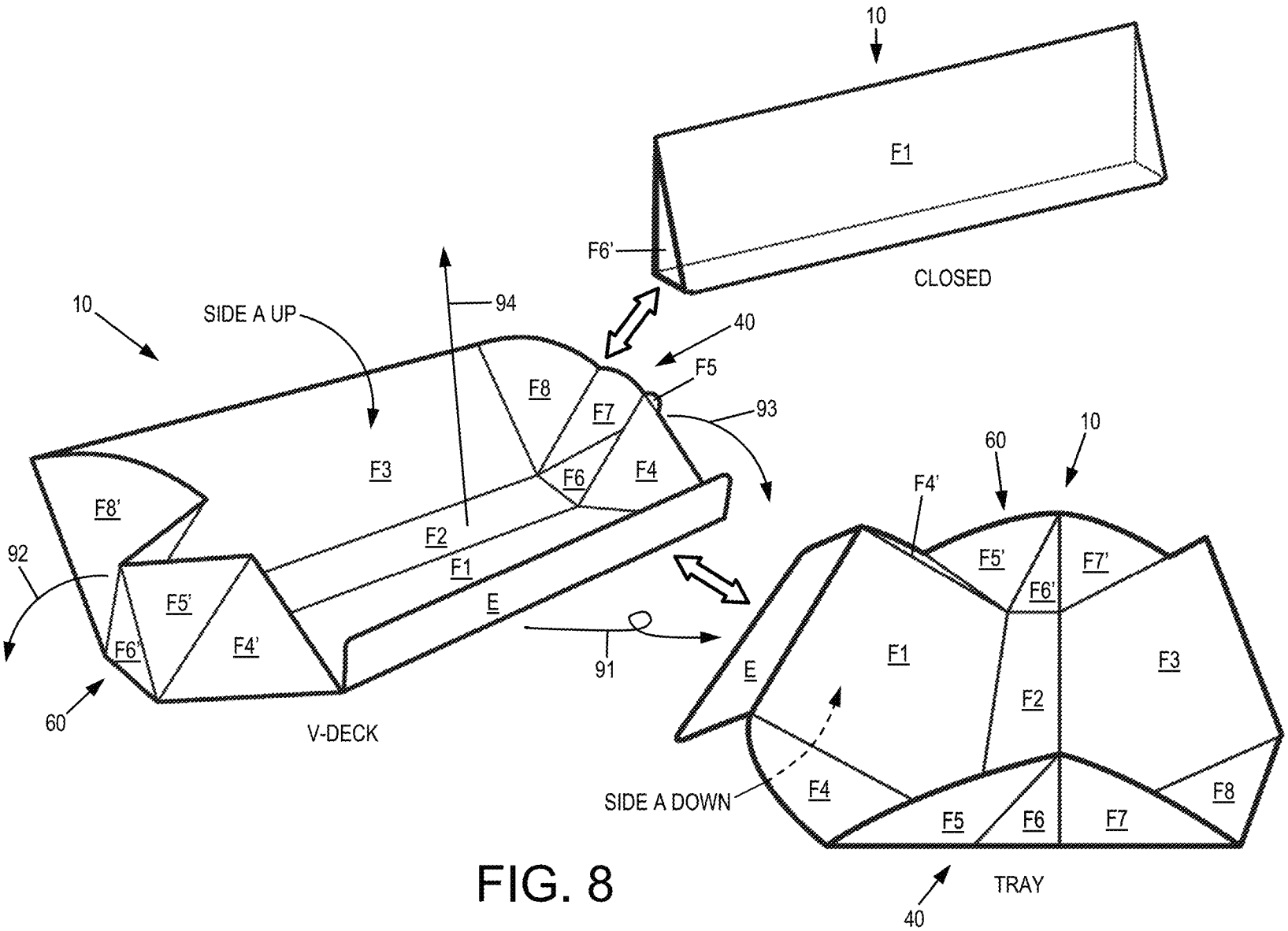
FIG. 8 is a set of perspective views of the smoking device showing simple conversions of the device from closed configuration to V-deck configuration to tray configuration, and vice-versa.

To form the V-deck configuration of FIGS. 2 and 8, particularly for the first time starting with the sheet material of FIG. 1, lower subpanel F3 is pivoted upwardly relative to central subpanel F2 at fold line 112. Upper subpanel F1 is pivoted upwardly relative to central subpanel F2 at fold line 111. This pair of folds results in the forming of a central portion of a V-deck cavity.

Left panel 40 is pivoted upwardly at fold lines 114, 120, and 119, and right panel 60 is pivoted upwardly at fold lines 114', 120', and 119'. Facet F5 is pivoted outwardly relative to facet F4 at fold line 115, and pivoted upwardly relative to facet F6 at fold line 116. Facet F7 is pivoted outwardly relative to facet F8 at fold line 118, and pivoted upwardly relative to facet F6 at fold line 117. Facet F6 is pivoted upwardly relative to central subpanel F2 at fold line 120. This sequence of folds results in each of the left panel facets being pivoted in a sequence of obtuse angles with respect to an adjacent left panel facet to form a left portion of the V-deck cavity. The triangular facet F6 is tilted outwardly and upwardly relative to the central subpanel F2, while the facet pairs F4/F5 and F7/F8 are tilted upwardly relative to the central subpanel F2, and inwardly relative to the triangular facet F6.

In like manner, facet F5' is pivoted outwardly relative to facet F4' at fold line 115', and pivoted upwardly relative to facet F6' at fold line 116'. Facet F7' is pivoted outwardly relative to facet F8' at fold line 118', and pivoted upwardly relative to facet F6' at fold line 117'. Facet F6' is pivoted upwardly relative to central subpanel F2 at fold line 120'. This sequence of folds results in each of the right panel facets being pivoted in a sequence of obtuse angles with respect to an adjacent right panel facet to form a right portion of the V-deck cavity. The triangular facet F6' is tilted outwardly and upwardly relative to the central subpanel F2, while the facet pairs F4'/F5' and F7'/F8' are tilted upwardly relative to the central subpanel F2, and inwardly relative to the triangular facet F6'. The resulting right portion of the V-deck cavity may be a mirror image of the left portion of the V-deck cavity.

In summary, as a result of these foldings, lower rectangular subpanel F3, central subpanel F2, and upper rectangular subpanel F1 form a V-deck that is bounded on the ends by left panel 40 and right panel 60, which are formed into the folded shapes as described above. Viewed in the longitudinal direction from fold line 120 to fold line 120', the V-deck cavity has the cross-sectional shape of an inverted trapezoid. Advantageously, the V-deck configuration provides a clean, hygienic container for mixing tobacco and/or placing a rolling paper, and then dispensing tobacco, and rolling a cigarette.

The smoking device 10 may further comprise a tab panel E hingably joined to the rectangular middle panel at fold line 110. When the device 10 is formed into the V-deck configuration as shown in FIG. 2, the tab panel E may be pivoted slightly downwardly relative to upper rectangular subpanel F1, so as to serve as a handle for the user. The handle can be gripped between the user's thumb and fingers to hold and move the device 10 as needed during cigarette rolling operations. Alternatively, as shown in FIG. 8, the tab panel E of the V-deck configuration may be tilted upwardly. This provides an additional barrier that helps to prevent the spilling of tobacco. The tab panel E may be joined to subpanel F1 as shown in the drawings, or to subpanel F3.

It is also noted that the outer perimeter edges of the facets F4-F8 and F4'-F8' may be arcuate or linear. By way of example in FIG. 1, facets F4, F5, and F7 and F4', F5, and F7' have arcuate edges R4, R5, and R7 and R4', R5, and R7', respectively; and facets F8 and F8' have linear edges R8 and R8', respectively. In other words, facets F4, F5, and F7 and F4', F5, and F7' have a sectoral shape, and facets F8 and F8" have a triangular shape. It is preferable that facets F8 and F8' have linear edges R8 and R8', respectively, because such linear edges facilitates the final tucking of the tab panel E behind subpanel F3 to configure the device 10 in the closed configuration as will now be described.

Figure 3:
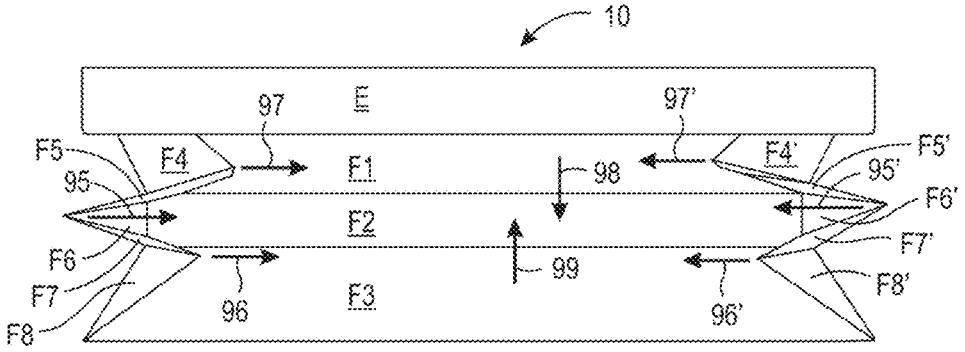
FIG. 3 is a plan view of the smoking device of FIG. 1, folded further beyond the V-deck configuration of FIG. 2 to place the device in a partially closed state.

FIG. 3 is a plan view of the smoking device of FIG. 1, folded further beyond the configuration of FIG. 2 to place the device in a partially closed state. It can be seen that subpanels F3 and F1 have been further pivoted upwardly relative to subpanel F2, and inwardly relative to each other as indicated by arrows 99 and 98. Additionally, facet pairs F4/F5 and F7/F8, and facet F6 have been pivoted inwardly as indicated by arrows 97, 96, and 95, respectively. Facet pairs F4 and F5 have been pivoted inwardly toward each other, and facet pairs F7 and F8 have been pivoted inwardly toward each other. In like manner, facet pairs F4'/F5' and F7'/F8', and facet F6' have been pivoted inwardly as indicated by arrows 97', 96', and 95', respectively. Tab panel E has also been pivoted inwardly to position it as a locking tab.

FIG. 4 is a perspective view of the smoking device of FIG. 1, folded to a closed state, and FIG. 5 is an end view of the smoking device 10 in the closed state, taken along the line 5-5 of FIG. 4. It can be seen that subpanels F3 and F1 have been further pivoted inwardly so as to be opposed to each other, and that facet pairs F4'/F5' and F7'/F8', and have been pivoted inwardly so as to be opposed to each other, respectively. Facet F6' has been pivoted upwardly relative to subpanel F2, and inwardly to a position substantially perpendicular to subpanel F2. Facets F4/F5 and F7/F8 and facet F6 (not shown in FIGS. 4 and 5) have also been pivoted in the same manner. Thus in the closed configuration of smoking device 10, subpanels F3 and F1 and facets F6 and F6' form an enclosed cavity, within which smoking items such as rolled cigarettes 2, matches (not shown), and other smoking items may be stored. Advantageously, rolled cigarettes may be contained in the enclosed cavity and saved for later use. Such cigarettes are protected from rough handling, such as when the smoking device in the closed state is jammed into a user's pants of jacket pocket. Additionally, if the rolling cigarette preparation has been started with the smoking device 10 in the V-deck of tray configuration, it may be paused, and the device 10 reverted to the closed position; the user may do another activity, or move to another location and then open the device 10 and resume the rolling process without losing or exposing tobacco.

It is also noted that when the lower rectangular subpanel F3 and upper rectangular subpanel F1 are pivoted with respect to the central subpanel F2 to the opposed position to form the enclosed cavity, the tab panel E may be engaged in a slot formed between the lower rectangular subpanel F3 and panel facets F8 and F8'. Referring to FIGS. 4 and 5, it can be seen that the tab panel E including outer edge 300 is secured behind lower rectangular subpanel F3 including outer edge 113. Thus the smoking device 10 is firmly secured in a closed position.

In the exemplary embodiment depicted in FIGS. 1-8, the left panel facet F6 and right panel facet F6' are triangular facets. Thus when the smoking device is configured in the closed position, the left panel facet F6 and right panel facet F6' form the ends of the cavity and define a triangular cross section of the enclosed cavity (or a substantially trapezoidal cross section with a narrow top wall). Other end facet shapes and cross-sections may be suitable while accomplishing the same result.

Referring again to FIG. 7, a cigarette rolling paper 4 is depicted in a tray configuration of the smoking device 10. It can be seen that the tray is dimensioned so that there is no deformation of the paper 4 along its entire length, and that immediately beyond the ends 3 and 5 of the paper 4, the folded left and right panels 20 and 40 form the ends of the tray. This configuration is advantageous because it enables rolling of the entire length of a cigarette while capturing substantially all of the tobacco and avoiding spillage of the tobacco.

Figure 6:
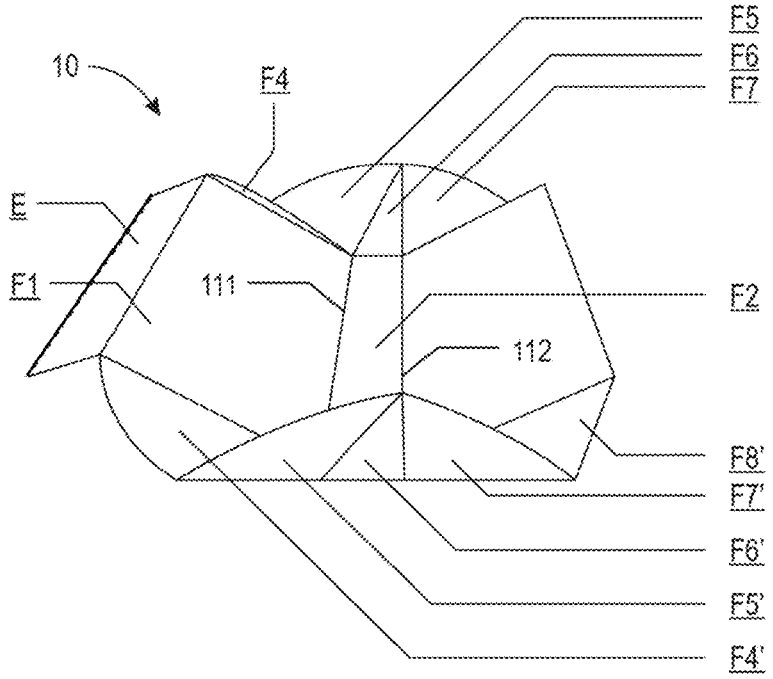
FIG. 6 is a side perspective view of the smoking device as shown in FIG. 2, folded to form a tray configuration.
Figure 7:
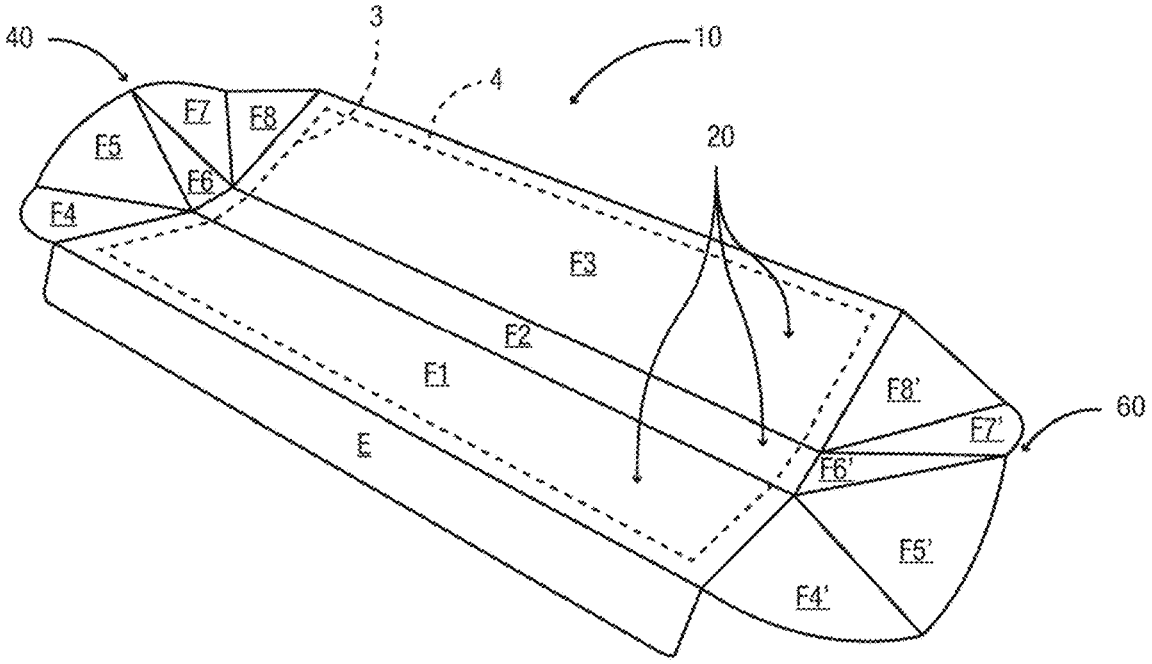
FIG. 7 is an upper perspective view of the smoking device as shown in FIG. 6 folded to form the tray configuration.

It is further noted that the smoking device 10 may be converted from the V-deck configuration to the tray configuration depicted in FIGS. 6, 7, and 8, and that such a conversion is remarkably simple by virtue of the unique combination of subpanels and facets of the smoking device 10. Referring to FIG. 8 in particular, and starting from the closed configuration depicted therein, the device 10 is converted to the V-deck configuration with side A up by following, in reverse order, the steps described in transitioning from the V-deck configuration of FIG. 2 to the closed configuration of FIGS. 4 and 5. From that point, the conversion to the tray configuration is easily made in just one or two seconds. The user simply presses the bottom subpanel F2 upwardly as indicated by arrow 94, while turning the left and right panels 40 and 60 downwardly in their folded configurations as indicated by respective arrows 93 and 92. The device 10 is then inverted as indicated by arrow 91, such that the A side is down.

The Applicant has found that by first folding the sheet material from the sheet configuration of FIG. 1 to the V-deck configuration of FIG. 2, and on to the closed configuration of FIGS. 4 and 5, such first folding results in the folds of the device having "memory," i.e., they naturally conform to their initial folds. Thus when a user first opens the device 10 from the closed configuration, the device naturally conforms to the V-deck configuration. Then when the user "pops" the device 10 "inside out" to go from the V-deck configuration to the tray configuration, the device 10 naturally conforms to the tray configuration; and likewise for transitioning from the tray configuration to the V-deck configuration. In other words, because of the memory of the folds in the material, the V-deck configuration and the tray configurations are stable states that are easily formed, and the state in between them is unstable, with "memory" forces present at the folds that tend to direct the device 10 to the V-deck configuration or the tray configuration.

The tray configuration is advantageous for mixing of tobacco because it provides a larger open tray volume for mixing, and also because it can be used as a tray for one or several cigarettes. It can be seen that in the tray configuration, the triangular facet F6 is tilted upwardly relative to the central subpanel F2 and inwardly relative to the facet pairs F4/F5 and F7/F8, and the triangular facet F6' is tilted upwardly relative to the central subpanel F2 and inwardly relative to the facet pairs F4'/F5' and F7'/F8'. Thus up to four cigarettes (not shown) can be placed in the tray, in the folds of F4/F5, F7/F8, F4'/F5', and F7'/F8', with all cigarettes extending inwardly toward the central region of subpanel F2.

Figure 12:
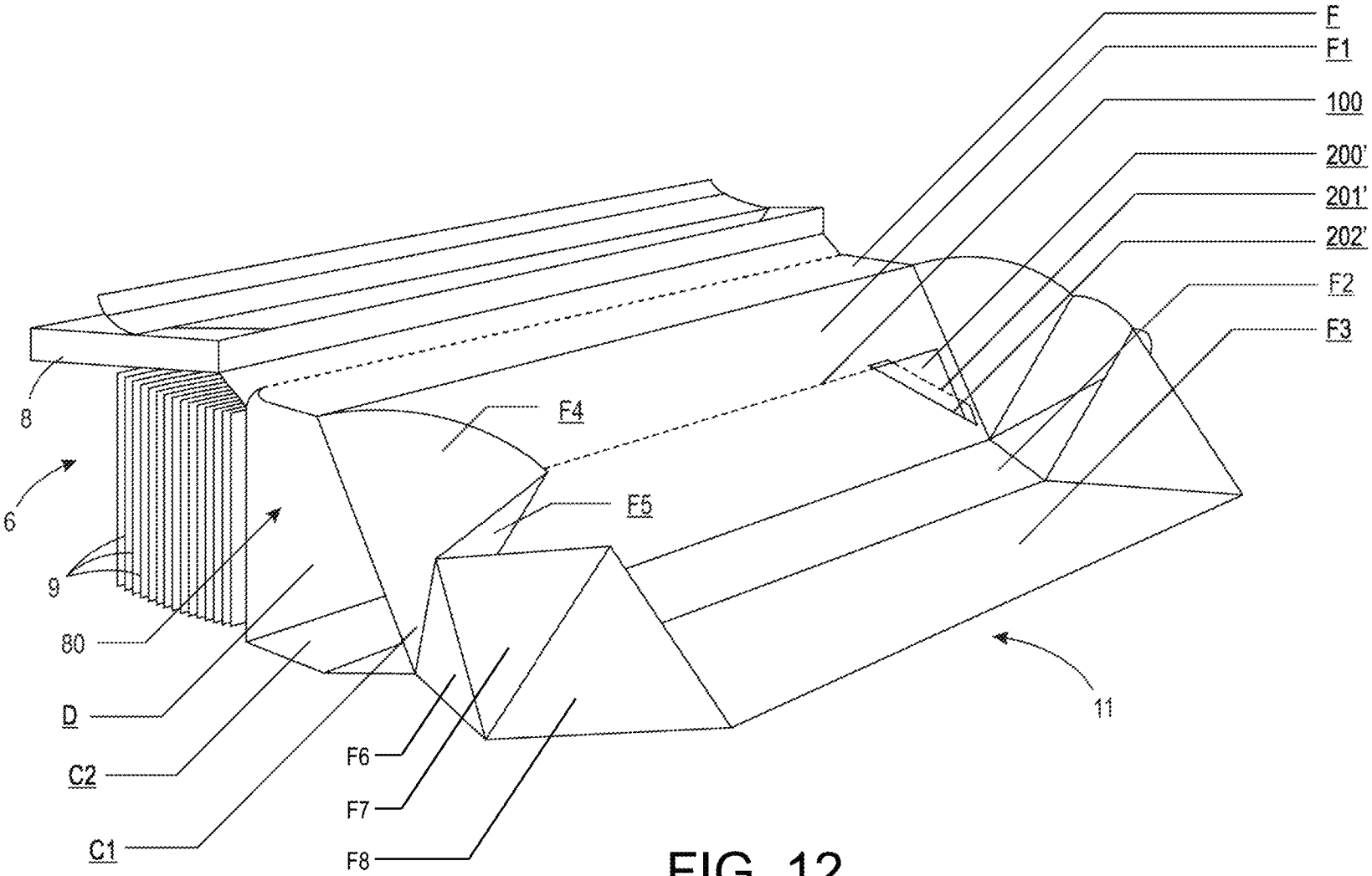
FIG. 12 is a perspective view of the smoking device of FIG. 8 with a packet of rolling papers and filter tips joined thereto, folded to the V-deck configuration, and further folded to provide an enclosed cavity for engagement with fingers of the hand to render the device wearable.

The smoking device 10 may also be configured in a V-trough configuration. In this additional configuration (see FIG. 13), the lower rectangular subpanel F3 is pivoted upwardly with respect to the central subpanel F2 at fold line 112. The angle of such pivoting may be approximately perpendicular as shown in FIG. 12, or the angle may be acute or obtuse. Additionally, the left panel 40 is folded along fold line 117, and the right panel 60 is folded along fold line 117', such that fold lines 112, 117, and 117' are collinear, or nearly so. Facets F7, F8, F7', F8', and lower subpanel F3 are coplanar, or nearly so along a first plane. Facets F4, F5, F6, F4', F5', F6', central subpanel F2, and upper subpanel F1 are coplanar or nearly so along a second plane. The second plane may be substantially perpendicular to the first plane, or may be at an obtuse or acute angle of about ±45 degrees from perpendicular. From the V-trough configuration of FIG. 13, the smoking device 10 may be further folded to substantially a zero degree angle along fold lines 117, 112, and 117' (see also FIG. 1) to render the device in a flat configuration. This flat configuration makes the device 10 conveniently portable in a carrier with flat surfaces, such as within the pages of a book. Referring to FIG. 1, in an alternative flat configuration, the device left panel 40 may be folded to a zero degree angle with central panel 20 along fold lines 114, 120, and 119, the device right panel 60 may be folded to a zero degree angle with central panel 20 along fold lines 114', 120', and 119', and panel E may be folded to a zero degree angle with subpanel F1 along fold line 110. This flat configuration makes the device 10 conveniently portable in a carrier such as a wallet.

The smoking device 10 may also be configured in a scoop or shovel configuration (not shown). In this configuration, the left panel 40 may be folded into the V-deck configuration, or slightly further towards the closed configuration, while the right panel 60 is left substantially unfolded. In that manner, the device in the scoop configuration is easy to grasp with the fingers at the V-deck end, and use the open end as a scoop to pick up tobacco from a surface.

Figure 9:
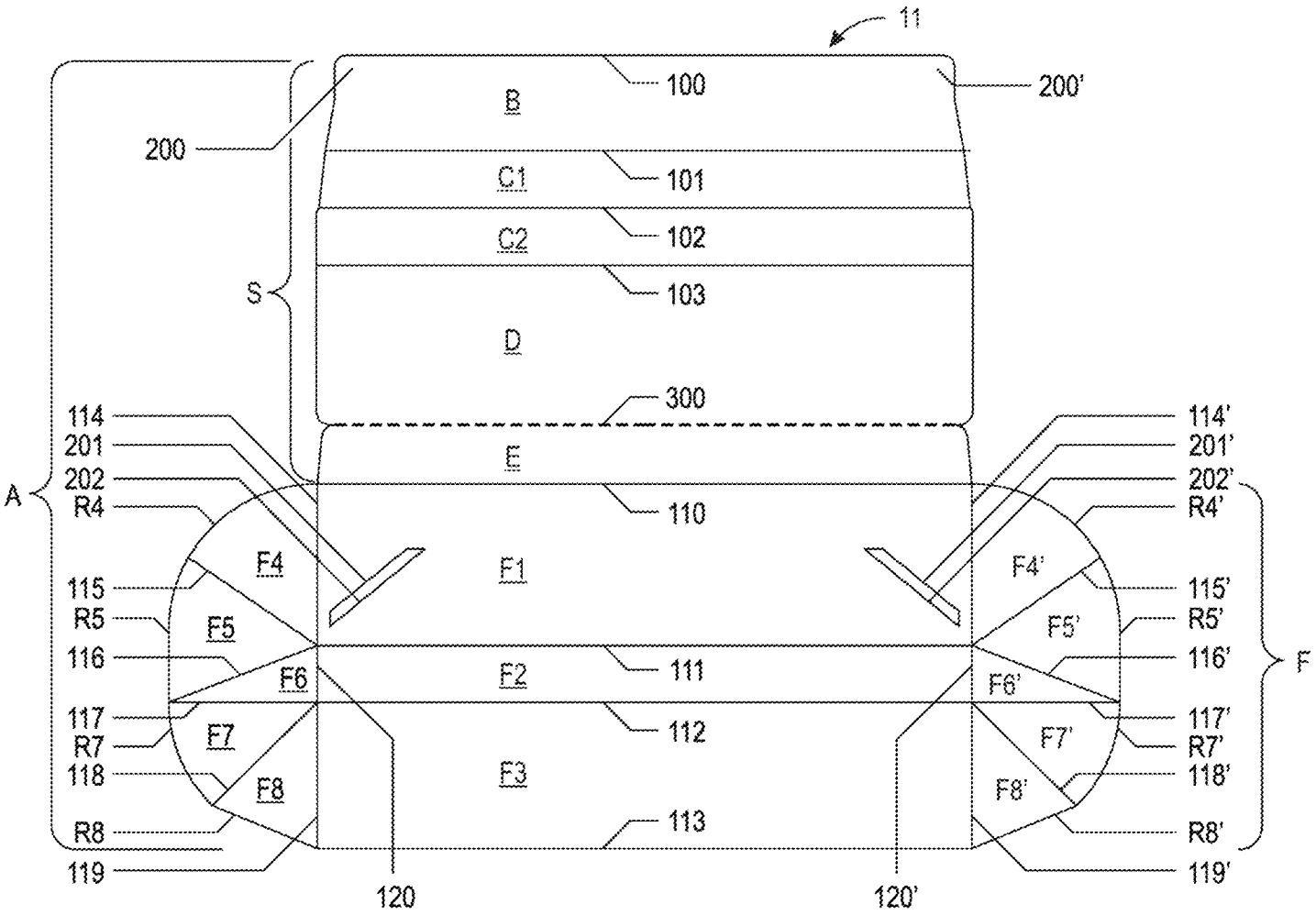
FIG. 9 is a plan view of a piece of sheet material cut in a pattern for forming a second embodiment of a smoking device of the present disclosure, shown with the top side ("A" side) facing upwardly (out of the page)
Figure 10:
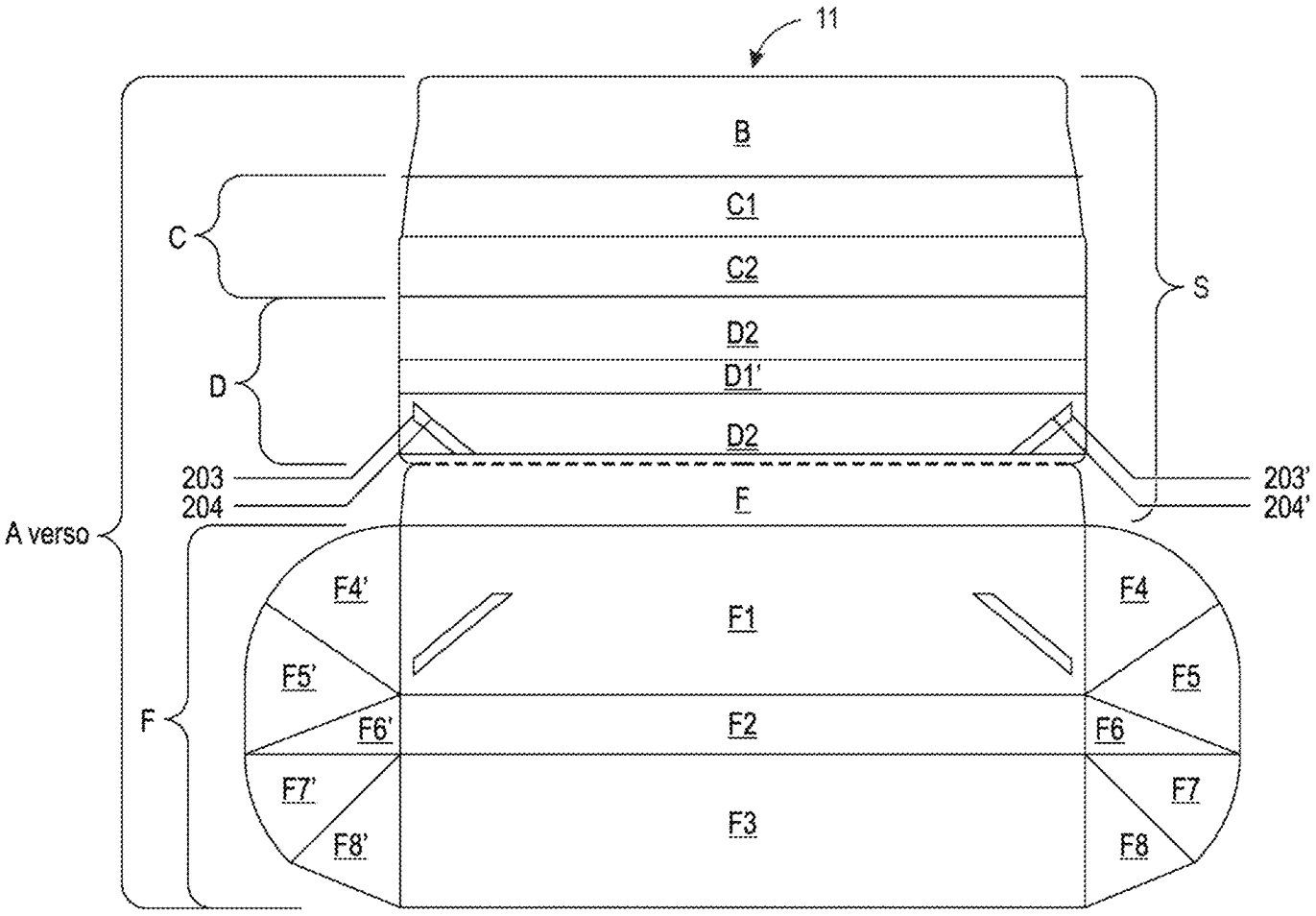
FIG. 10 is a plan view of the piece of sheet material of FIG. 8, but inverted with respect to FIG. 8 and thus shown with the bottom side ("A verso" side) facing upwardly (out of the page), and with a rolling paper packet/dispenser attached thereto.

A second embodiment of a smoking device of the present disclosure will now be described with reference to FIGS. 9-15. Referring first to FIGS. 9 and 10, fabrication of the smoking device 11 begins by cutting a piece of sheet material in a pattern that enables the formation of the device 11 by folding along certain line segments to form desired subpanels and facets. Suitable sheet materials are as described for the device 10 of FIGS. 1-8.

The smoking device 11 is comprised of a cigarette fabrication portion F and a storage and wearable portion S. In certain embodiments, the smoking device 11 may be provided as a single piece (cut by a die, laser, or other suitable means) such that cigarette fabrication portion F and a storage and wearable portion S are joined to each other in the as-cut state. The cigarette fabrication portion F and storage and wearable portion S may subsequently be separated from each other by cutting or tearing at fold line 300, resulting in the smoking device 10 described previously. In other embodiments, the cigarette fabrication portion F and a storage and wearable portion S may be cut as separate pieces, each sharing a common subpanel (such as subpanel E), and then joined together by overlapping the common panels of each and joining them by suitable means such as adhesive.

The cigarette fabrication portion F may include the panels, subpanels, and facets as described previously for device 10, i.e. the rectangular middle panel 20, the left panel 40, and the right panel 60. The rectangular middle panel 20 is comprised of the central rectangular subpanel F2, hingably joined to the lower rectangular subpanel F3, and hingably joined to the upper rectangular subpanel F1. The left panel 40 is hingably joined to a left edge of the rectangular middle panel 20 and comprises a plurality of left panel facets F4-F8 hingably joined to each other. The right panel 60 is hingably joined to a right edge of the rectangular middle panel 20 and comprises a plurality of right panel facets F4'-F8' hingably joined to each other.

Figure 15:
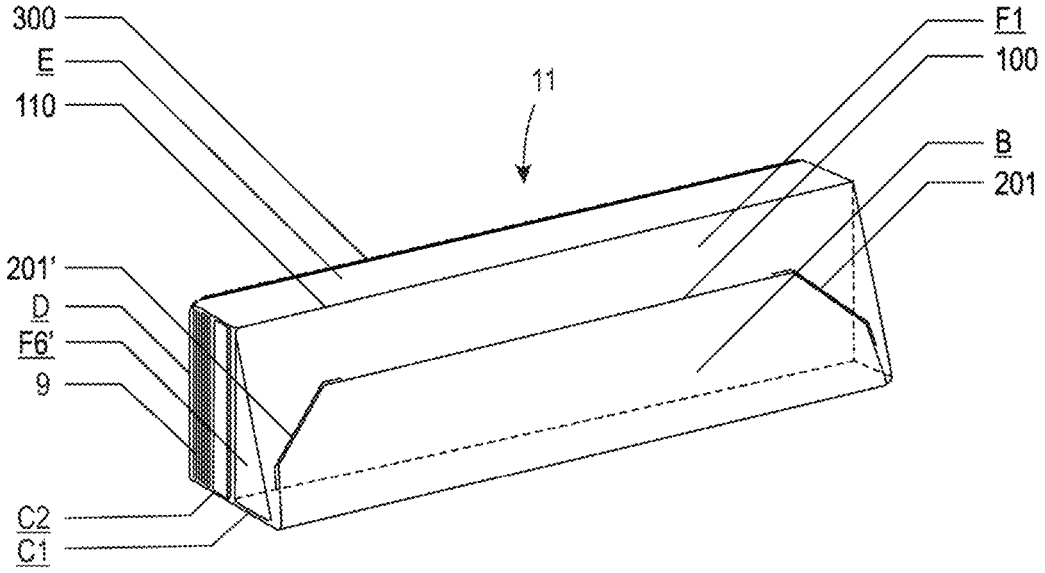
FIG. 15 is a perspective view of the smoking device of FIG. 8, folded to a fully closed configuration.

The lower rectangular subpanel F3 and upper rectangular subpanel F1 are pivotable with respect to the central subpanel F2 to an opposed position forming an enclosed cavity. The left panel facets F4-F8 are pivotable so as to be contained within the enclosed cavity, and the right panel facets F4'-F8' are also pivotable so as to be contained within the enclosed cavity. FIG. 15 depicts the smoking device 11 in a closed configuration. It can be seen that the above-described cigarette fabrication portion F of the device 11 is in substantially the same closed configuration as shown in FIGS. 4 and 5.

Figure 11:
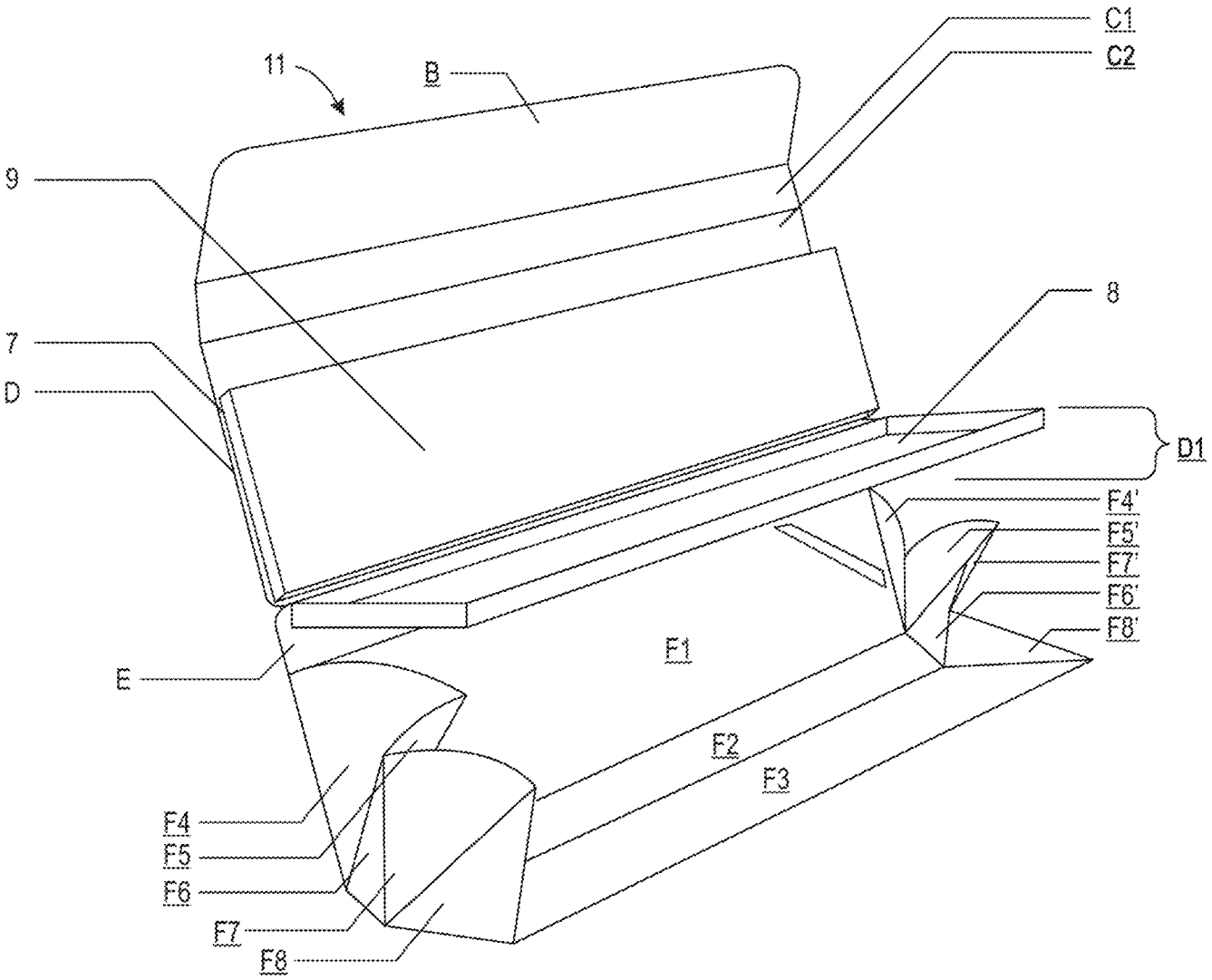
FIG. 11 is a perspective view of the smoking device of FIG. 8, folded to a V-deck configuration, and with a packet of rolling papers and filter tips joined thereto.
Figure 14:
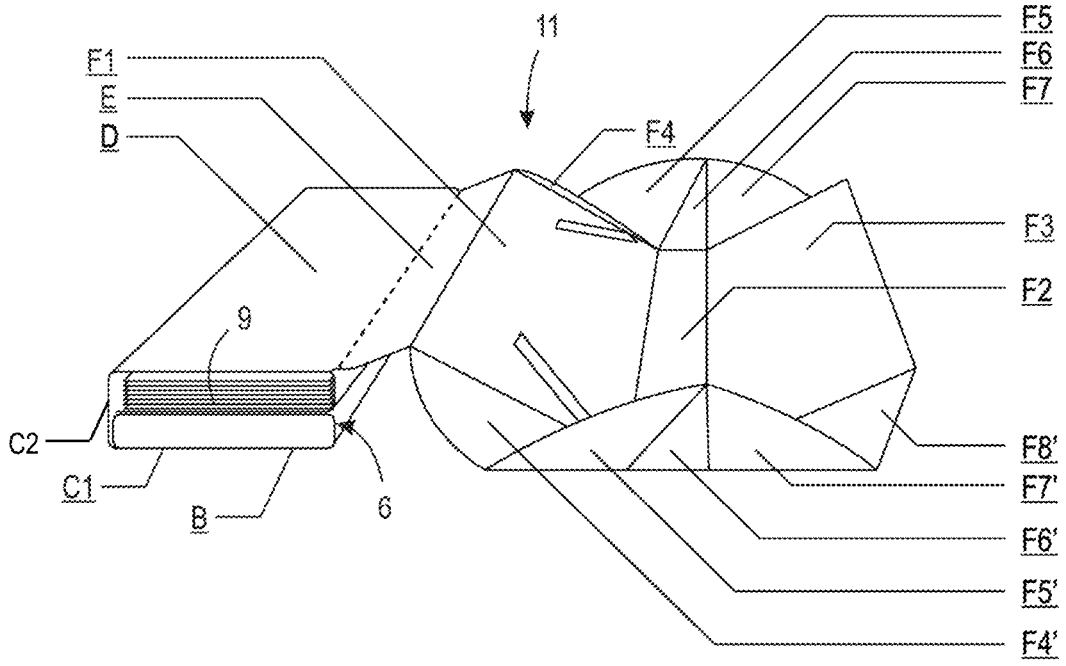
FIG. 14 is a perspective view of the smoking device folded into a tray configuration with the packet of rolling papers and filter tips contained in a storage enclosure.

It is noted that the cigarette fabrication portion F including the panels, subpanels, and facets as described may also be configured in the tray configuration and the V-deck configuration as described previously for the smoking device 10 of FIGS. 1-8. The device 11 with cigarette fabrication portion F in the tray configuration is depicted in FIG. 14. The device 11 with cigarette fabrication portion F in the V-deck configuration is depicted in FIGS. 11 and 12. The subpanel and facet foldings to result in these configurations are as described previously for smoking device 10 and thus need not be repeated here.

Referring again to FIGS. 9 and 10, the storage and wearable portion S of the smoking device 11 is formed as an extension middle panel S hingably joined to an outer edge 110 of the upper rectangular subpanel F1. The extension middle panel S is comprised of a plurality of subpanels B, C1, C2, D, and E hingably joined to each other at fold lines 101, 102, 103, and 300, which are parallel to the outer edge 110 of the upper rectangular subpanel F1. These subpanels may be folded into different arrangements to provide the device in a storage configuration and a wearable configuration. Such arrangements and configurations will now be described.

In describing the folding of the smoking device 11 into these various configurations, the folding motions of the various panels, subpanels, and facets (upwardly, downwardly, etc.) may be described relative to the original position of the smoking device 11 in an unfolded state on a horizontal surface as shown in FIG. 9 with the top/A side up, or in some configurations, relative to the original position of the smoking device 11 in an unfolded state on a horizontal surface as shown in FIG. 10 with the bottom/A verso side up. However, it is to be understood that in making the folds, a user will likely pick the smoking device 11 up from a surface in sheet form and proceed to fold it using the fingers of both hands, holding it in various positions. It is also to be understood that the smoking device 11 can be converted from any given configuration shown in FIGS. 11-15 to any other configuration shown in FIGS. 11-15. Accordingly, the orders of making the folds may vary from the orders presented below for the various configurations.

Referring to FIGS. 11-15, the smoking device 11 is depicted in these drawings with a packet of rolling papers 6. It is to be understood that the packet of rolling papers 6 is not necessarily a part of the smoking device 11. Instead, the packet of rolling papers 6 is illustrated to demonstrate the ability of the smoking device 11 to present the rolling papers when the device 11 is configured for a cigarette rolling operation, and to store the packet of rolling papers 6 when the device 11 is in the closed configuration.

Referring to FIGS. 11 and 12, the packet of rolling papers 6 may be comprised of a container comprising a back panel 7, a rolling papers 8, and filter tips 9. (In FIG. 11, the filter tips 9 are shown as being contiguous with each other in the container, and in FIGS. 12 and 13, the filter tips 9 are shown as being separated or "fanned out" from each other for purposes of illustration.) The back panel 7 of the packet 6 is joined to the top (A) side of the sheet of material on subpanel D. The joining may be made with a suitable adhesive, or by double-sided tape or other suitable adhesive means. The joining may be reversible, i.e., an adhesive or tape may be provided that is strong enough to hold the packet 6 to subpanel D, but weak enough to enable removal after all of the rolling papers are consumed, so that a new packet 6 can be fitted to the device 11.

Referring again to FIG. 11, a perspective view of the smoking device 11 is depicted, folded to a V-deck configuration, and with a packet 6 of rolling papers presented on an upper region of the device 11. The device 11 is shown with the A side surfaces of the subpanels F1, F2, and F3 visible. The folding of subpanels F1, F2, and F3 and facets F4-F8 and F4'-F8' to form a V-deck have already been described with reference to FIG. 2, and will not be repeated here. To form the paper presenting configuration, with the tray formed having subpanel F1 directed at an upward acute angle with respect to horizontal, tab panel E, subpanel D, and subpanel C2 may be maintained substantially coplanar with subpanel F1. Subpanel C1 may be folded forwardly at a slight obtuse angle with respect to subpanel C2, and subpanel B may be folded forwardly at a slight obtuse angle with respect to subpanel C1.

Referring again to FIG. 12, a perspective view of the smoking device 11 is depicted folded to a V-deck configuration, and with the packet of rolling papers joined thereto. FIG. 12 also shows a wearable configuration of the device 11, further folded to provide an enclosed cavity for engagement with fingers of the hand. The device 11 is shown with the A side surfaces of the subpanels F1, F2, and F3 visible.

Again, the folding of subpanels F1, F2, and F3 and facets F4-F8 and F4'-F8' to form a V-deck need not be repeated here. To form the wearable configuration with enclosed cavity 80, with the V-deck formed having subpanel F1 directed at an upward acute angle with respect to horizontal, tab panel E is folded downwardly at an obtuse angle with subpanel F1; subpanel D is folded downwardly approximately perpendicular to tab panel E; subpanel C2 is folded forwardly approximately perpendicular to subpanel D; subpanel C1 may be folded slightly upwardly relative to subpanel C2, or may be substantially coplanar with subpanel C2; and subpanel B is folded upwardly and rearwardly relative to subpanel C1, to a position that is substantially coplanar and contiguous with subpanel F1. In this position, the corners of subpanel B may be inserted into the slots 200 and 200', formed by cuts 201/202, and 201'/202', respectively. Inserting corners 200 and 200' into the slots removably joins subpanel B to subpanel F1, thereby securing the device 11 in this wearable configuration. The enclosed cavity 80 has a cross-sectional shape of an irregular pentagon, and is suitable for a user to insert his fingers or thumb therein. The user can then easily manipulate the device with dexterity to facilitate cigarette making. Alternatively, the user can set the device down on a level surface (not shown), since the bottom of the V-deck (subpanel F2) and subpanel C2 form a base for the device 11. It can be seen that in this configuration, a rolling paper 7 can be obtained from the packet 6 joined to subpanel D on the rearward side of the device 11. Advantageously, in this configuration, the smoker can mix and roll his smoking articles "on the go," and also pause the rolling process at any phase.

Figure 13:
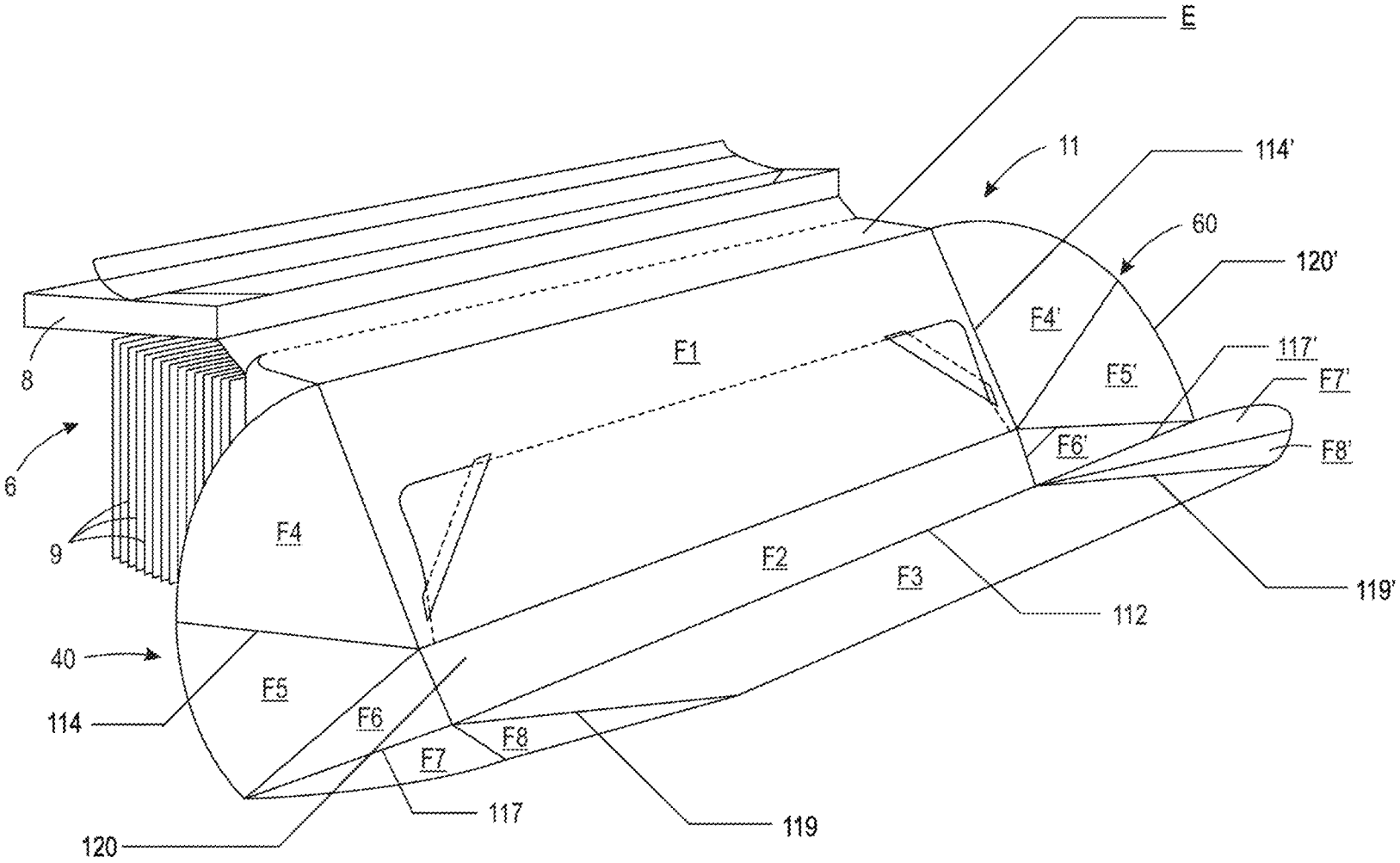
FIG. 13 is a perspective view of the smoking device as shown in FIG. 11 with a packet of rolling papers and filter tips joined thereto, but folded in a V-trough configuration.

Referring to FIG. 13, a perspective view of the smoking device 11 is depicted folded to a V-trough configuration, with the packet of rolling papers joined thereto. FIG. 13 also shows the wearable configuration of the device 11, further folded to provide an enclosed cavity for engagement with fingers of the hand. The device 11 is shown with the A side surfaces of the subpanels F1, F2, and F3 visible.

The folding of subpanels F1, F2, and F3 and facets F4-F8 and F4'-F8' to form a tray are as described previously, and the folding of tab panel E and subpanels D, C2, C1, and B to form the wearable configuration are also as described previously, and thus will not be repeated here.

FIG. 14 is a perspective view of the smoking device 11 folded into a tray configuration with the packet of rolling papers contained in a storage enclosure. The configuration of FIG. 14 may be obtained by starting with the device 11 as shown in FIG. 11 or 12 in the V-deck configuration. The subpanel B is released from the slots 200 and 200' of subpanel F1 (for the FIG. 12 and FIG. 13 configurations), the cover 8 of the rolling paper packet 6 is closed, and the device 11 is inverted so that the A verso side is up. The cigarette fabrication portion F of the device is then formed into the tray configuration as described previously, by popping the central subpanel F2 downwardly relative to the faceted left and right panels 40 and 60 to turn the device 10 "inside out." Alternatively, the popping step may be performed before inverting the device A verso side up as described previously. (It is noted that the tray configuration and the V-deck configuration can be formed by the cigarette fabrication portion F regardless of whether the device is A side up or A verso side up. However, because of the previously described "memory" of the folds, the tray configuration is preferred for the A verso side up, and the V-deck configuration is preferred for the A side up.) The packet of rolling papers 6 is contained by placing it in a horizontal position beneath subpanel D, pivoting subpanel C2 downwardly to a position substantially perpendicular to subpanel D, and pivoting subpanels C1 and B forwardly to a position substantially perpendicular to subpanel C2. Advantageously, also in this configuration, the smoker can mix and roll his smoking articles "on the go," and also pause the rolling process at any phase. During the rolling process, the smoker may hold the rolling paper with one hand and spread the tobacco evenly in the tray using the other hand, without spilling tobacco from either end of the paper, while maintaining the paper in a stable position at all times.

FIG. 15 is a perspective view of the smoking device 11 folded to a fully closed configuration. The configuration of FIG. 15 may be obtained easily from the configuration of the device 11 as shown in FIG. 15. The cigarette fabrication portion F of the device is reconfigured from the tray configuration to the closed configuration as described previously and shown in FIGS. 6 and 7. The packet 6 of rolling papers is rotated 90 degrees counterclockwise so that it is upright. Subpanel C2 remains in the same position relative to the packet 6 of rolling papers, while subpanel C1 is moved to be beneath the folded and closed cigarette fabrication portion F. Subpanel B is folded upwardly relative to subpanel C1 so as to enclose the cigarette fabrication portion F. The corners 200 and 200' are tucked into the slots formed by cuts 201/202 and 201'/202' (FIG. 8) in subpanel F1, thereby locking the device 11 in the fully closed position. Advantageously, in this configuration, the smoker's articles and/or fabricated cigarettes may be stored for later usage.

Figure 16:
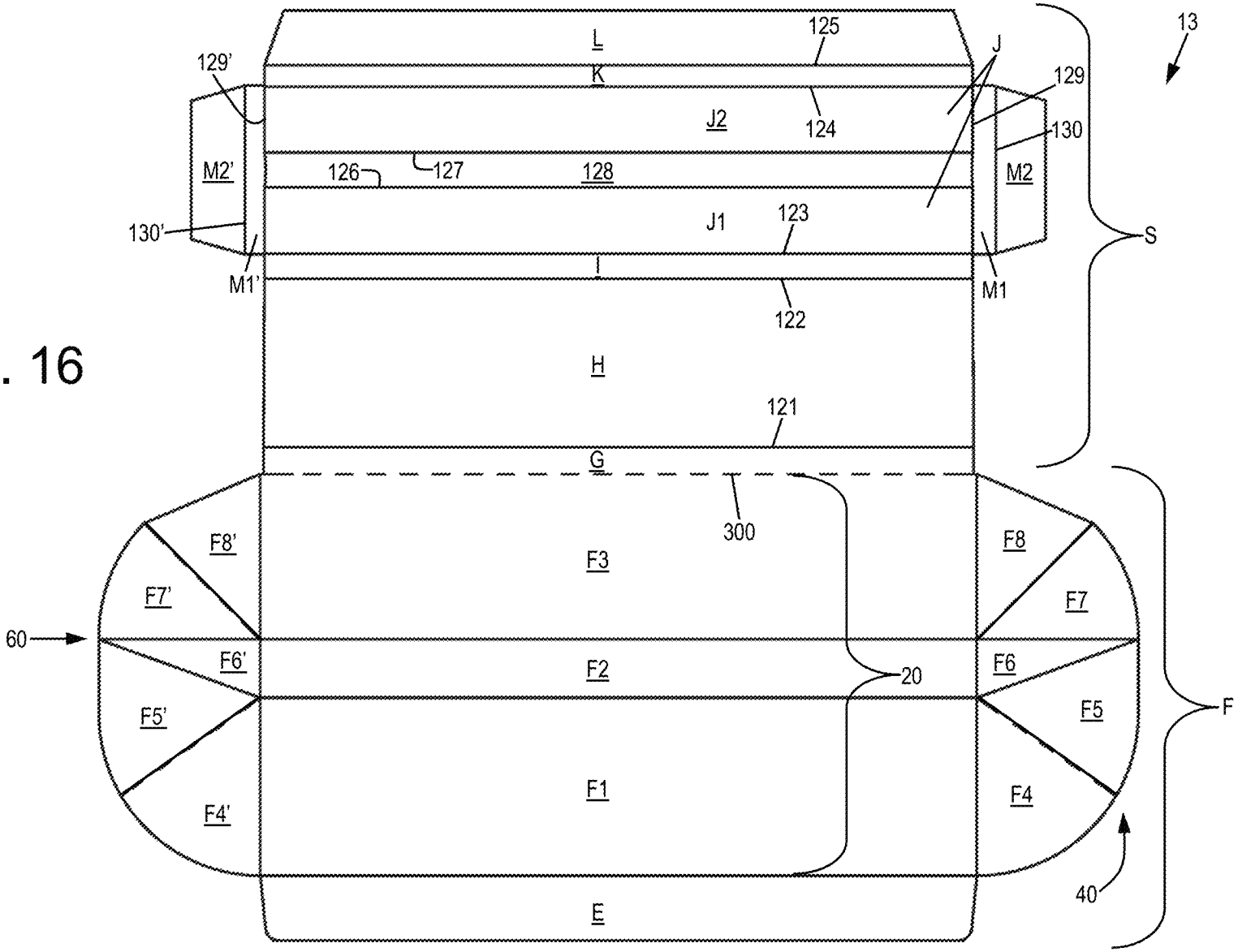
FIG. 16 is a plan view of a piece of sheet material cut in a pattern for forming a third embodiment of a smoking device of the present disclosure.

A third embodiment of a smoking device of the present disclosure will now be described with reference to FIGS. 16-18. Referring first to FIG. 16, fabrication of the smoking device 13 begins by cutting a piece of sheet material in a pattern that enables the formation of the device 13 by folding along certain line segments to form desired subpanels and facets. Suitable sheet materials are as described for the device 10 of FIGS. 1-7.

The smoking device 13 is comprised of a cigarette fabrication portion F and a storage portion S. In certain embodiments, the smoking device 13 may be provided as a single piece (cut by a die, laser, or other suitable means) such that cigarette fabrication portion F and a storage portion S are joined to each other in the as-cut state. The cigarette fabrication portion F and storage portion S may subsequently be separated from each other by cutting or tearing at fold line 300, resulting in the smoking device 10 described previously. In other embodiments, the cigarette fabrication portion F and a storage and wearable portion S may be cut as separate pieces, each sharing a common subpanel (such as subpanel G), and then joined together by overlapping the common panels of each and joining them by suitable means such as adhesive.

The cigarette fabrication portion F may include the panels, subpanels, and facets as described previously for device 10, i.e. the rectangular middle panel 20, the left panel 40, and the right panel 60. The rectangular middle panel 20 is comprised of the central rectangular subpanel F2, hingably joined to the lower rectangular subpanel F3, and hingably joined to the upper rectangular subpanel F1. The left panel 40 is hingably joined to a left edge of the rectangular middle panel 20 and comprises a plurality of left panel facets F4-F8 hingably joined to each other. The right panel 60 is hingably joined to a right edge of the rectangular middle panel 20 and comprises a plurality of right panel facets F4'-F8' hingably joined to each other.

The lower rectangular subpanel F3 and upper rectangular subpanel F1 are pivotable with respect to the central subpanel F2 to an opposed position forming an enclosed cavity. The left panel facets F4-F8 are pivotable so as to be contained within the enclosed cavity, and the right panel facets F4'-F8' are also pivotable so as to be contained within the enclosed cavity. FIG. 14 depicts the smoking device 11 in a closed configuration. The device 13 in the closed configuration will be as previously described for device 10 and as shown in FIGS. 4 and 5, and device 11 as shown in FIG. 15.

It is noted that the cigarette fabrication portion F including the panels, subpanels, and facets as described may also be configured in the tray configuration and the V-deck configuration as described previously for the smoking device 10 of FIGS. 1-8. The device 13 with cigarette fabrication portion F in the tray configuration is depicted in FIG. 18. The device 13 with cigarette fabrication portion F in the V-deck configuration is depicted in FIG. 17. The subpanel and facet foldings to result in these configurations are as described previously for smoking device 10 and thus need not be repeated here. It can be seen that the conversion of the device 13 in the V-deck configuration as shown in FIG. 17 to the device 13 in the tray configuration as shown in FIG. 18 can easily be made by popping the device 13 "inside out" and inverting it as described previously.

Referring again to FIG. 16, the storage portion S of the smoking device 11 is formed as an extension middle panel S hingably joined to an edge 300 of the rectangular subpanel F3. The extension middle panel S is comprised of a plurality of subpanels H, I, J, K, and L hingably joined to each other at fold lines 121, 122, 123, 124, and 125, which are parallel to the outer edge 300 of the rectangular subpanel F3. Subpanel J is comprised of subpanels J1 and J2. The respective inner edges 126 and 127 of subpanels J1 and J2 define upper and lower perimeter edges of an open slot 128 formed between them. The subpanels H, I, J, K, and L may be folded into an arrangement to provide the device 13 with a paper packet storage cavity, as will now be described.

In describing the folding of the smoking device 13 into various configurations, the folding motions of the various panels, subpanels, and facets (upwardly, downwardly, etc.) may be described relative to the original position of the smoking device 13 in an unfolded state on a horizontal surface as shown in FIG. 16 with the top side up, or in some configurations, relative to the original position of the smoking device 13 in an unfolded state on a horizontal surface with the bottom side up. However, it is to be understood that in making the original folds, a user will likely pick the smoking device 13 up from a surface in sheet form and proceed to fold it using the fingers of both hands, holding it in various positions. It is also to be understood that the smoking device 13 can be converted from the V-deck configuration shown in FIG. 17 to the tray configuration shown in FIG. 18, as well as a V-trough, scoop, and closed configurations (not shown, but as described previously for devices 10 and 11). Accordingly, the orders of making the folds may vary from the orders presented herein for the various configurations.

Figure 17:
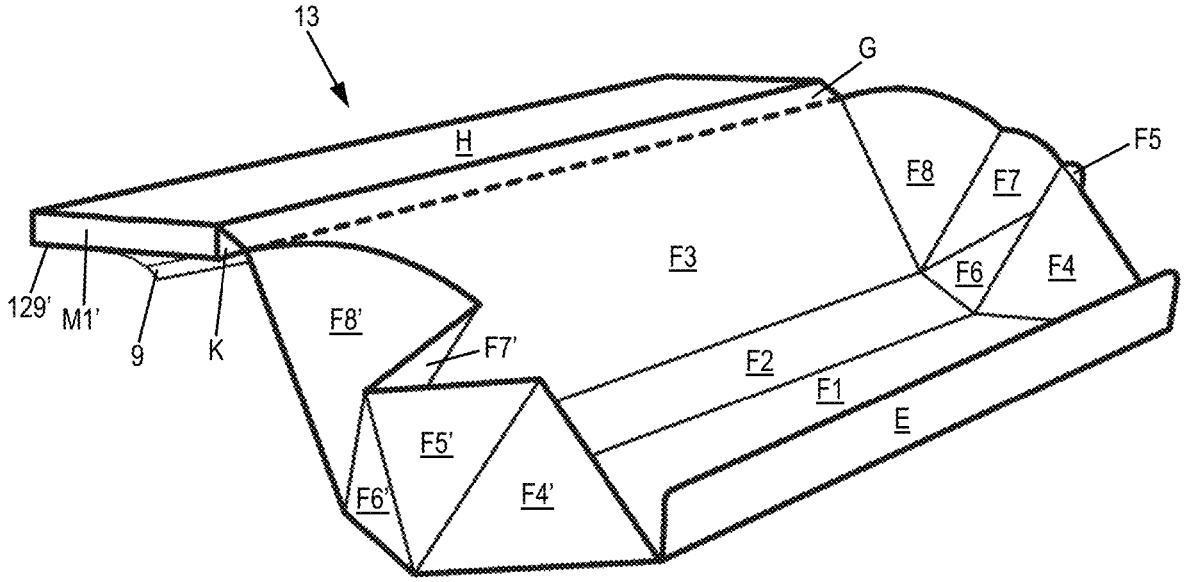
FIG. 17 is a perspective view of the device of FIG. 16, folded into a V-deck configuration.
Figure 18:
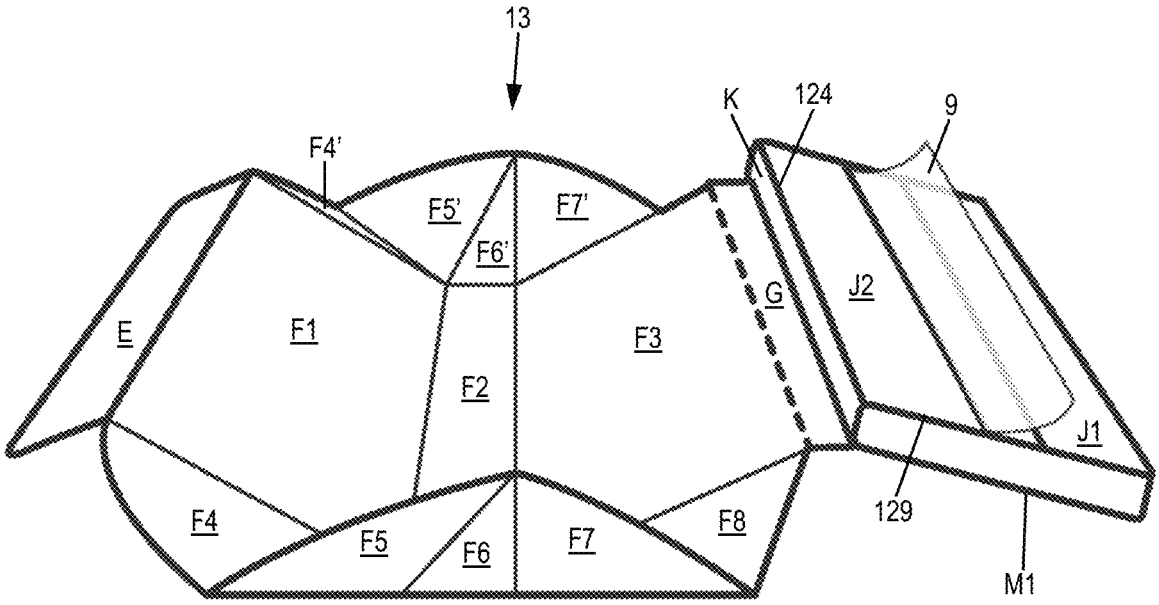
FIG. 18 is a perspective view of the device of FIG. 17, popped "inside out" and turned over, to render the device in a tray configuration.

Referring to FIGS. 17 and 18, the smoking device 13 is depicted in these drawings with a packet of rolling papers contained in a storage cavity of the device 13, and ready to dispense a rolling paper 9. It is to be understood that the packet of rolling papers is not necessarily a part of the smoking device 13. Instead, the packet of rolling papers with paper 9 is illustrated to demonstrate the ability of the smoking device 13 to present a rolling paper 9 when the device 13 is configured for a cigarette rolling operation, and to store the packet of rolling papers when the device 13 is in the closed configuration.

Referring to FIGS. 17 and 18, a packet of rolling papers including paper 9 may be rectangular in form, and may be as packet 6 (FIGS. 10-14) described previously, including a back panel 7, a cover 8, and individual rolling paper sheets 9. Referring to FIG. 16, to form the cavity for storage of a packet of rolling papers 6, the packet of rolling papers may be disposed upon subpanel J, with a top rolling paper 9 passing through slot 128 as shown in FIG. 18 so that it is available for dispensing. such that subpanels J1 and J2 are facing upwardly with rolling paper 9 extending through slot 128, as shown in FIG. 18. Subpanel K is folded 90 degrees relative to subpanel J2 at fold line 124, and subpanel L is folded 90 degrees relative to subpanel K at fold line 125, and tucked under the packet 6 of rolling papers so that subpanel K is contiguous with subpanel H. As a result of these consecutive 90 degree folds, the subpanels H-K form a cavity for storage of the rolling paper packet 6, with subpanel L being rotated a total of 360 degrees and tucked in to secure the storage cavity in a closed position.

Additionally, subpanel M1 is folded 90 degrees relative to subpanels J1 and J2 at fold line 129, and subpanel M2 is folded 90 degrees relative to subpanel M1 at fold line 130, and tucked under the packet 6 of rolling papers so that subpanel M2 is contiguous with subpanel H. In like manner, subpanel M1' is folded 90 degrees relative to subpanels J1 and J2 at fold line 129', and subpanel M2' is folded 90 degrees relative to subpanel M1' at fold line 130', and tucked under the packet 6 of rolling papers so that subpanel M2' is contiguous with subpanel H. With the foldings of the subpanels M1, M2, M1', and M2', the packet of rolling papers 6 is completely enclosed and secured in the cavity.

It is therefore apparent that there has been provided, in accordance with the present disclosure, smoking devices having multifunctional capabilities for making individual cigarettes and cigars. The foregoing description of technology and the invention is merely exemplary in nature of the subject matter, manufacture, and use of the invention and is not intended to limit the scope, application, or uses of any specific invention claimed in this application or in such other applications as may be filed claiming priority to this application, or patents issuing therefrom. The following definitions and non-limiting guidelines must be considered in reviewing the description.

The headings in this disclosure (such as "Background" and "Summary") and sub-headings used herein are intended only for general organization of topics within the present technology, and are not intended to limit the disclosure of the present technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The description and specific examples, while indicating embodiments of the technology disclosed herein, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

Unless otherwise specified, relational terms used in the present disclosure should be construed to include certain tolerances that those skilled in the art would recognize as providing equivalent functionality. By way of example, the term "perpendicular" is not necessarily limited to 90.00°, but also to any variation thereof that those skilled in the art would recognize as providing equivalent functionality for the purposes described for the relevant member or element. Terms such as "about" and "substantially" in the context of configuration relate generally to disposition, location, and/or configuration that is either exact or sufficiently close to the location, disposition, or configuration of the relevant element to preserve operability of the element within the invention while not materially modifying the invention. Similarly, unless specifically specified or clear from its context, numerical values should be construed to include certain tolerances that those skilled in the art would recognize as having negligible importance, as such do not materially change the operability of the invention.

As used herein, the words "comprise," "include," contain," and variants thereof are intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

All numbers disclosed herein are approximate values, regardless whether the word "about" or "approximate" is used in connection therewith. They may vary by 1%, 2%, 5%, and sometimes, 10 to 20%.

Having thus described the basic concept of the invention, it will be apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be expressly stated in the claims.

I claim:

1. A granular material handling device formed from a sheet of material having a top surface and a bottom surface, the device comprising:

a rectangular middle panel comprising a central rectangular subpanel hingably joined to a lower rectangular subpanel along a first fold line, and hingably joined to an upper rectangular subpanel along a second fold line;

a left panel hingably joined to a left edge of the rectangular middle panel along a third fold line and comprising a plurality of left panel facets hingably joined to each other, including a leftward right triangular facet with a short leg and a long leg, the leftward right triangular facet hingably joined to a left edge of the central rectangular panel with the short leg perpendicular to the first fold line, and hingably joined via the leftward right triangle long leg to a leftward adjacent facet at a fourth fold line collinear with the first fold line; and a right panel hingably joined to a right edge of the rectangular middle panel along a fifth fold line and comprising a plurality of right panel facets hingably joined to each other, including a rightward right triangular facet with a short leg and a long leg, the rightward right triangular facet hingably joined to a right edge of the central rectangular panel with the short leg perpendicular to the first fold line, and hingably joined via the rightward right triangle long leg to a rightward adjacent facet at a sixth fold line collinear with the first fold line;

wherein:

the lower rectangular subpanel and upper rectangular subpanel are pivotable with respect to the central subpanel along the respective first and second fold lines so as to orient the upper and lower rectangular subpanels to an opposed position forming an enclosed cavity;

the left panel facets are pivotable with respect to each other so as to position the long leg of the leftward right triangular facet perpendicular to the central rectangular panel and define a left end of the enclosed cavity, and to position a remainder of the plurality of left panel facets within the enclosed cavity;

the right panel facets are pivotable with respect to each other so as to position the long leg of the rightward right triangular facet perpendicular to the central rectangular panel and define a right end of the enclosed cavity, and to position a remainder of the plurality of right panel facets within the enclosed cavity, thereby placing the device in a closed configuration defining a triangular cross-section shape;

the first fold line, fourth fold line, and sixth fold line define a longitudinally extending collinear fold line as defined by the device;

simultaneously, to render the device in a flat configuration, the leftward right triangular facet is foldable 180 degrees with respect to the leftward adjacent facet along the collinear fold line, the central rectangular subpanel is foldable 180 degrees with respect to the lower rectangular subpanel along the collinear fold line, and the rightward right triangular facet is foldable 180 degrees with respect to the rightward adjacent facet along the collinear fold line.

2. The device of claim 1, wherein the lower rectangular subpanel, upper rectangular subpanel, central subpanel, left panel facets, and right panel facets are selectively pivotable with respect to each other so as to enable the device to be unfolded from the closed configuration into a V-deck configuration having the top surface of the sheet of material facing upwardly, and to be inverted and transformed into a tray configuration having the bottom surface of the sheet of material facing upwardly.

3. The device of claim 2, wherein the V-deck configuration is formable by pivoting the lower rectangular subpanel and upper rectangular subpanel with respect to the central subpanel to form a cavity having trapezoidal cross-sectional shape, and by pivoting the left panel facets with respect to each other so as to form a first end of the cavity, and by pivoting the right panel facets with respect to each other so as to form a second end of the cavity.

4. The device of claim 3, wherein the tray configuration is formable from the V-deck configuration by inverting the position of the central subpanel with respect to the lower rectangular subpanel and upper rectangular subpanel, and by inverting pairs of left lateral facets with respect to a left central facet, and by inverting pairs of right lateral facets with respect to a right central facet, and by inverting the sheet of material such that the bottom surface of the sheet of material faces upwardly.

5. The device of claim 2, wherein the device in the V-deck configuration is in a first stable state, the device in the tray configuration is in a second stable state, and a transformation of the device between the V-deck configuration and the tray configuration passes the device through an unstable state.

6. The device of claim 2, wherein when the device is placed in the tray configuration, the lower rectangular subpanel and upper rectangular subpanel are each pivoted upwardly with respect to the central subpanel to an obtuse angle to form a central portion of a tray cavity, and wherein each of the left panel facets are pivoted in a left sequence of obtuse angles with respect to an adjacent left panel facet to form a left portion of the tray cavity, and each of the right panel facets are pivoted in a right sequence of obtuse angles with respect to an adjacent left panel facet to form a right portion of the tray cavity, thereby placing the device in a tray configuration.

7. The device of claim 6, further comprising a tab panel hingably joined to an outer edge of the upper rectangular subpanel, and pivoted downwardly at an obtuse angle with respect to the upper rectangular subpanel.

* * * * *